US010739058B2

(12) United States Patent
Okazaki et al.

(10) Patent No.: US 10,739,058 B2
(45) Date of Patent: Aug. 11, 2020

(54) DEW CONDENSATION REMOVAL STRUCTURE AND COOLING/HEATING EQUIPMENT INCLUDING DEW CONDENSATION REMOVAL STRUCTURE

(71) Applicant: PANASONIC CORPORATION, Osaka (JP)

(72) Inventors: Toru Okazaki, Osaka (JP); Masanori Minamio, Osaka (JP)

(73) Assignee: PANASONIC CORPORATION, Osaka (JP)

( * ) Notice: Subject to any disclaimer, the term of this patent is extended or adjusted under 35 U.S.C. 154(b) by 142 days.

(21) Appl. No.: 15/848,607

(22) Filed: Dec. 20, 2017

(65) Prior Publication Data

US 2018/0172334 A1 Jun. 21, 2018

(30) Foreign Application Priority Data

Dec. 20, 2016 (JP) ..... 2016-246088
Sep. 11, 2017 (JP) ..... 2017-173803

(51) Int. Cl.

| | |
|---|---|
| ***F25D 21/14*** | (2006.01) |
| ***F25D 23/02*** | (2006.01) |
| ***F25D 11/00*** | (2006.01) |
| ***F25D 21/08*** | (2006.01) |
| ***F25D 21/06*** | (2006.01) |

(52) U.S. Cl.

CPC ..... *F25D 21/14* (2013.01); *F25D 11/00* (2013.01); *F25D 23/02* (2013.01); *F25D 23/028* (2013.01); *F25D 2323/021* (2013.01); *F25D 2500/02* (2013.01)

(58) Field of Classification Search

CPC ..... F25D 21/14; F25D 23/02; F25D 23/028; F25D 11/00

USPC ..... 62/275

See application file for complete search history.

(56) References Cited

U.S. PATENT DOCUMENTS 3,905,203 A * 9/1975 Jacob ..... F24F 3/1405 62/272

FOREIGN PATENT DOCUMENTS

JP 2010-249491 A 11/2010
JP 2014134377 A * 7/2014

OTHER PUBLICATIONS

Shimazaki Juichi, Jul. 2014, European Patent Office, English Translation (Year: 2014).*

* cited by examiner

*Primary Examiner* — Steve S Tanenbaum
(74) *Attorney, Agent, or Firm* — McDermott Will & Emery LLP

(57) ABSTRACT

Disclosed are a dew condensation removal structure that removes dew condensation generated in equipment using cold such as refrigerating/freezing equipment and air conditioning equipment and that suppresses power consumption necessary to remove the dew condensation, and cooling/heating equipment including the dew condensation removal structure. The cooling/heating equipment uses the dew condensation removal structure, including: a cooling structure having a cooling surface that is directly or indirectly cooled by cold, the cooling surface facing outside air; and a dew condensation conveyance section provided on the cooling surface, in which the dew condensation conveyance section has a conveyance path that conveys dew condensation by capillary phenomenon, the dew condensation being generated on a surface of the dew condensation conveyance section.

14 Claims, 11 Drawing Sheets

DEW CONDENSATION REMOVAL STRUCTURE AND COOLING/HEATING EQUIPMENT INCLUDING DEW CONDENSATION REMOVAL STRUCTURE

CROSS REFERENCE TO RELATED APPLICATIONS

This application is entitled to and claims the benefit of Japanese Patent Application No. 2016-246088, filed on Dec. 20, 2016 and No. 2017-173803, filed on Sep. 11, 2017, the disclosures of which including the specifications, drawings and abstracts are incorporated herein by reference in their entirety.

TECHNOLOGICAL FIELD

The present invention relates to a dew condensation removal structure that removes dew condensation generated in equipment using cold such as refrigerating/freezing equipment and air conditioning equipment, and to cooling/heating equipment including the dew condensation removal structure.

BACKGROUND ART

Conventionally, mechanisms that prevent dew condensation are provided in cooling/heating equipment such as refrigerating/freezing equipment and air conditioning equipment. As an example of the cooling/heating equipment, a home refrigerator will be described.

For example, a refrigerator disclosed in Japanese Patent Application Laid-Open No. 2010-249491 has double doors (French doors). A left door and a right door are provided on a front surface of a storage chamber. A rotary partition body is provided at an end portion of the left door. When the left door and the right door are closed, a gasket of the right door is brought into close contact with the rotary partition body of the left door such that airtightness between the left door and the right door is ensured.

The gasket of the right door contacts not only the rotary partition body of the left door but also cold air in the storage chamber. Therefore, cold in the storage chamber is transferred to a surface on a side of outside air of the rotary partition body via the gasket of the right door. When surface temperature on the side of the outside air of the rotary partition body falls below dew point temperature of outside air, water vapor in the outside air condenses, and dew condensation may generate on the surface on the side of the outside air of the rotary partition body.

For this reason, a heating apparatus such as an aluminum foil heater is provided in the rotary partition body of the refrigerator disclosed in Japanese Patent Application Laid-Open No. 2010-249491. The dew condensation on the rotary partition body is prevented by heating an entire surface on the side of the outside air of the rotary partition body by the heating apparatus such that the surface temperature is equal to or higher than the dew point temperature of the outside air.

CITATION LIST

Patent Literature

PTL 1
Japanese Patent Application Laid-Open No. 2010-249491

SUMMARY OF INVENTION

Technical Problem

However, in the conventional refrigerator, it is necessary to supply electric power to the heating apparatus in order to prevent dew condensation on the rotary partition body. In recent years, it is required to suppress power consumption of the refrigerator more than ever, and also to suppress power consumption for preventing dew condensation as much as possible.

In order to reduce the power consumption for preventing dew condensation, there has been developed a technology for detecting temperature and humidity of outside air, and controlling the electric power supplied to the heating apparatus of the rotary partition body on the basis of the temperature and the humidity of the outside air. However, under a condition where dew condensation is likely to generate, it is necessary to continue supplying the electric power to the heating apparatus, which sometimes makes it difficult to suppress the power consumption.

An object of the present invention is to provide a dew condensation removal structure that removes dew condensation generated in equipment using cold such as refrigerating/freezing equipment and air conditioning equipment and that suppresses power consumption necessary to remove dew condensation, and cooling/heating equipment including the dew condensation removal structure.

Solution to Problem

A dew condensation removal structure of the present invention includes: a cooling structure having a cooling surface that is directly or indirectly cooled by cold, the cooling surface facing outside air; and a dew condensation conveyance section provided on the cooling surface, in which the dew condensation conveyance section has a conveyance path that conveys dew condensation by capillary phenomenon, the dew condensation being generated on a surface of the dew condensation conveyance section.

Further, cooling/heating equipment of the present invention includes the dew condensation removal structure of the present invention.

Advantageous Effects of Invention

According to a dew condensation removal structure and cooling/heating equipment of the present invention, dew condensation generated on a surface of a dew condensation conveyance section is conveyed through a conveyance path. Accordingly, surface area of the dew condensation is enlarged and vaporization is promoted. As a result, the dew condensation generated by a cooling surface can be removed, and power consumption necessary to remove the dew condensation can be suppressed.

DESCRIPTION OF EMBODIMENTS

Figure 1:
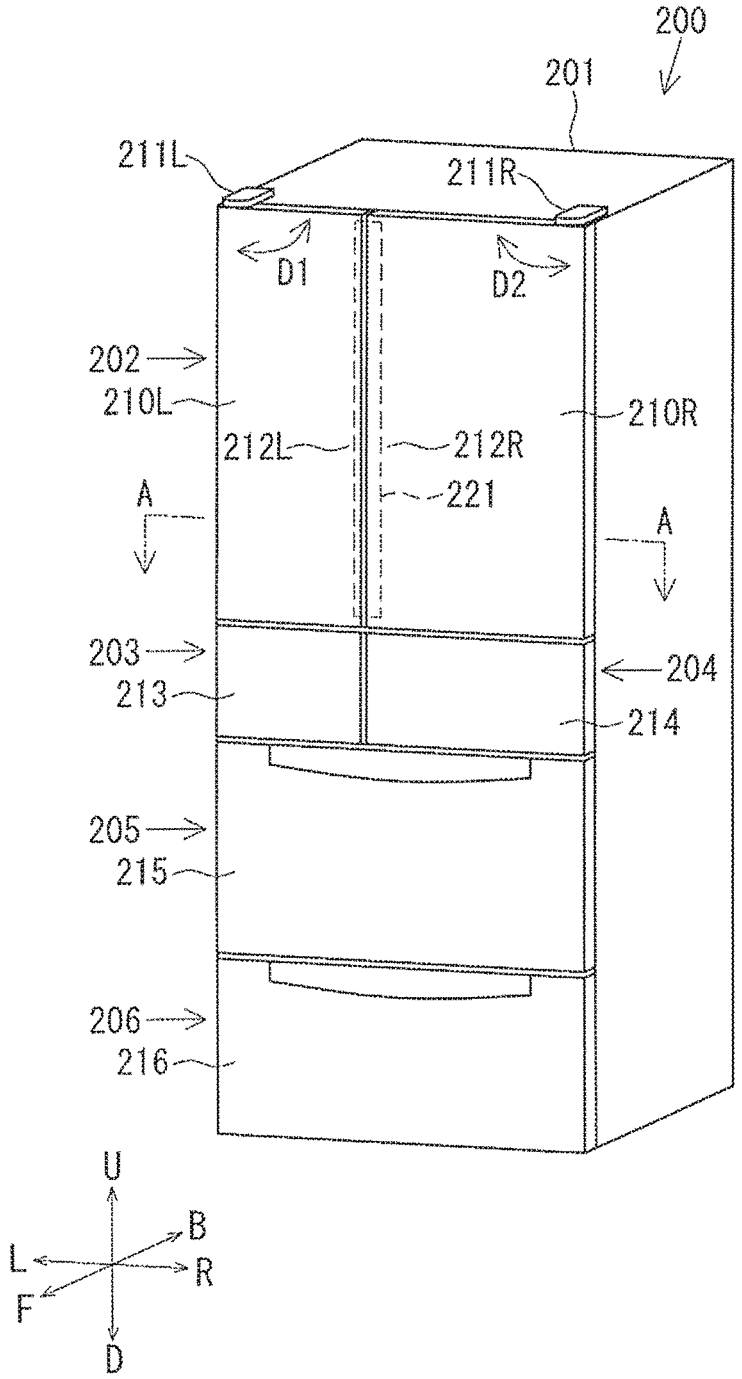
FIG. 1 is a perspective view of a refrigerator according to Embodiment 1 of the present invention.

A dew condensation removal structure according to an embodiment of the present invention includes: a cooling structure having a cooling surface that is directly or indirectly cooled by cold, the cooling surface facing outside air; and a dew condensation conveyance section provided on the cooling surface, in which the dew condensation conveyance section has a conveyance path that conveys dew condensation by capillary phenomenon, the dew condensation being generated on a surface of the dew condensation conveyance section (first configuration).

With the above configuration, since the dew condensation generated on the surface of the dew condensation conveyance section is conveyed through the conveyance path, surface area of the dew condensation is enlarged and vaporization is promoted. As a result, the dew condensation generated by the cooling surface can be removed, and power consumption necessary to remove the dew condensation can be suppressed.

In the above first configuration, a diffusion section having surface temperature higher than surface temperature of the cooling surface may be further provided, and the conveyance path may convey the dew condensation to the diffusion section (second configuration).

With the above configuration, the dew condensation generated on the surface of the dew condensation conveyance section is conveyed to the diffusion section, and vaporization is promoted in the diffusion section.

In the above second configuration, a heating section that increases temperature of the diffusion section may be further provided (third configuration).

With the above configuration, since the heating section is provided only in a part of the cooling structure, the heating section can be downsized, and the power consumption necessary to remove the dew condensation can be suppressed.

In the above first to third configurations, the conveyance path may have a plurality of grooves (fourth configuration).

With the above configuration, the dew condensation can be rapidly conveyed through the conveyance path having the plurality of grooves.

In the fourth configuration, each of the grooves may have a width of an opening portion of 10 μm to 500 μm, a depth of 10 μm to 500 μm, and an interval to an adjacent groove of 10 μm to 500 μm (fifth configuration).

With the above configuration, the dew condensation can be rapidly conveyed by capillary phenomenon and the grooves on the cooling surface can be made inconspicuous. Therefore, the dew condensation removal structure can be applied to a portion visible from a user and the like.

In the above first to fifth configurations, the dew condensation conveyance section may include the conveyance path formed on the cooling surface (sixth configuration).

With the above configuration, since the conveyance path is directly formed on the cooling surface, the dew condensation removal structure can be easily formed even in a case where area of the cooling surface is large.

In the above first to fifth configurations, the dew condensation conveyance section may include a sheet-like member and the conveyance path formed on a surface of the sheet-like member, and the sheet-like member may be stuck to the cooling surface (seventh configuration).

With the above configuration, the dew condensation removal structure can be easily configured by sticking, to the cooling surface, the sheet-like member on which the conveyance path is formed.

In the above first to seventh configurations, the cooling structure may be a rotary partition body (eighth configuration).

With the above configuration, since the dew condensation generated on the surface of the dew condensation conveyance section of the rotary partition body is conveyed by the conveyance path, surface area of the dew condensation is enlarged and vaporization is promoted. As a result, the dew condensation generated by the cooling surface can be removed, and power consumption necessary to remove the dew condensation can be suppressed.

Cooling/heating equipment according to an embodiment of the present invention includes a storage chamber, a first door and a second door located at an opening portion of the storage chamber, and the dew condensation removal structure of the eighth configuration arranged at a position surrounded by the storage chamber, the first door, and the second door (ninth configuration).

With the above configuration, in a case where dew condensation is generated on the surface of the dew condensation removal structure of the cooling/heating equipment on the surface of which the dew condensation is likely to generate, the dew condensation is conveyed by the conveyance path. Accordingly, surface area of the dew condensation is enlarged and vaporization is promoted. As a result, the dew condensation generated by the cooling surface can be removed, and power consumption necessary to remove the dew condensation can be suppressed.

In the ninth configuration, the cooling surface may be the surface of the dew condensation removal structure between the first door and the second door (tenth configuration).

With the above configuration, in a case where dew condensation is generated on the surface of the dew condensation removal structure provided between the first door and the second door of the cooling/heating equipment, the dew condensation is conveyed by the conveyance path. Accordingly, surface area of the dew condensation is enlarged and vaporization is promoted. As a result, the dew condensation generated by the cooling surface can be removed, and power consumption necessary to remove the dew condensation can be suppressed.

The cooling/heating equipment according to an embodiment of the present invention includes the dew condensation removal structure according to the above first to eighth configurations.

With the above configuration, since the dew condensation generated on the surface of the dew condensation conveyance section is conveyed through the conveyance path, surface area of the dew condensation is enlarged and vaporization is promoted. As a result, the dew condensation generated by the cooling surface can be removed, and power consumption necessary to remove the dew condensation can be suppressed.

Embodiment 1

Hereinafter, dew condensation removal structure 100 and refrigerator 200 according to an embodiment of the present invention will be described in detail with reference to the drawings. Refrigerator 200 of the present embodiment is an example of cooling/heating equipment to which dew condensation removal structure 100 of the embodiments is applied, and application of dew condensation removal structure 100 of the embodiments is not limited only to refrigerator 200. Moreover, the cooling/heating equipment is not limited to refrigerator 200.

In the drawings, the same parts or parts corresponding to each other are denoted by the same reference signs, and description thereof will not be repeated. Note that in order to make the description easy to understand, in the drawings referred to below, the configuration is simplified or schematically illustrated, or some components are omitted. Moreover, a dimensional ratio between the components illustrated in each drawing does not necessarily indicate an actual size ratio.

[Overall Configuration]

First, an overall configuration of refrigerator 200 will be described. FIG. 1 is a perspective view of refrigerator 200 according to Embodiment 1 of the present invention. In the following drawings, arrow R indicates a right direction of refrigerator 200 or dew condensation removal structure 100, and arrow L indicates a left direction thereof. Arrow U indicates an upward direction, and arrow D indicates a downward direction. Arrow F indicates a forward direction, and Arrow B indicates a backward direction.

As illustrated in FIG. 1, refrigerator 200 includes refrigerator main body 201. Refrigerator main body 201 includes a heat insulating wall filled with a heat insulating material. The interior of refrigerator main body 201 is partitioned also by the heat insulating wall into refrigerating storage chamber 202, ice making chamber 203, switchable storage chamber 204, freezing storage chamber 205, and vegetable storage chamber 206. In each chamber of refrigerator main body 201, cold air is separately supplied from a refrigeration cycle (not illustrated).

Openable/closable doors filled with the heat insulating materials are provided in opening portions of refrigerating storage chamber 202, ice making chamber 203, switchable storage chamber 204, freezing storage chamber 205, and vegetable storage chamber 206. Left door 210L and right door 210R, which are double doors (French doors), are provided in refrigerating storage chamber 202. Drawer-type doors 213, 214, 215 and 216 are respectively provided in ice making chamber 203, switchable storage chamber 204, freezing storage chamber 205, and vegetable storage chamber 206.

Left door 210L is supported by hinge 211L and can be opened and closed in a direction of arrow D1. Right door 210R is supported by hinge 211R and can be opened and closed in a direction of arrow D2. Rotary partition body 221 is provided inside free end 212L of left door 210L. In a state where left door 210L and right door 210R are closed, a free end 212R of right door 210R is brought into close contact with rotary partition body 221 to suppress leakage of cold air from refrigerating storage chamber 202.

Figure 2:
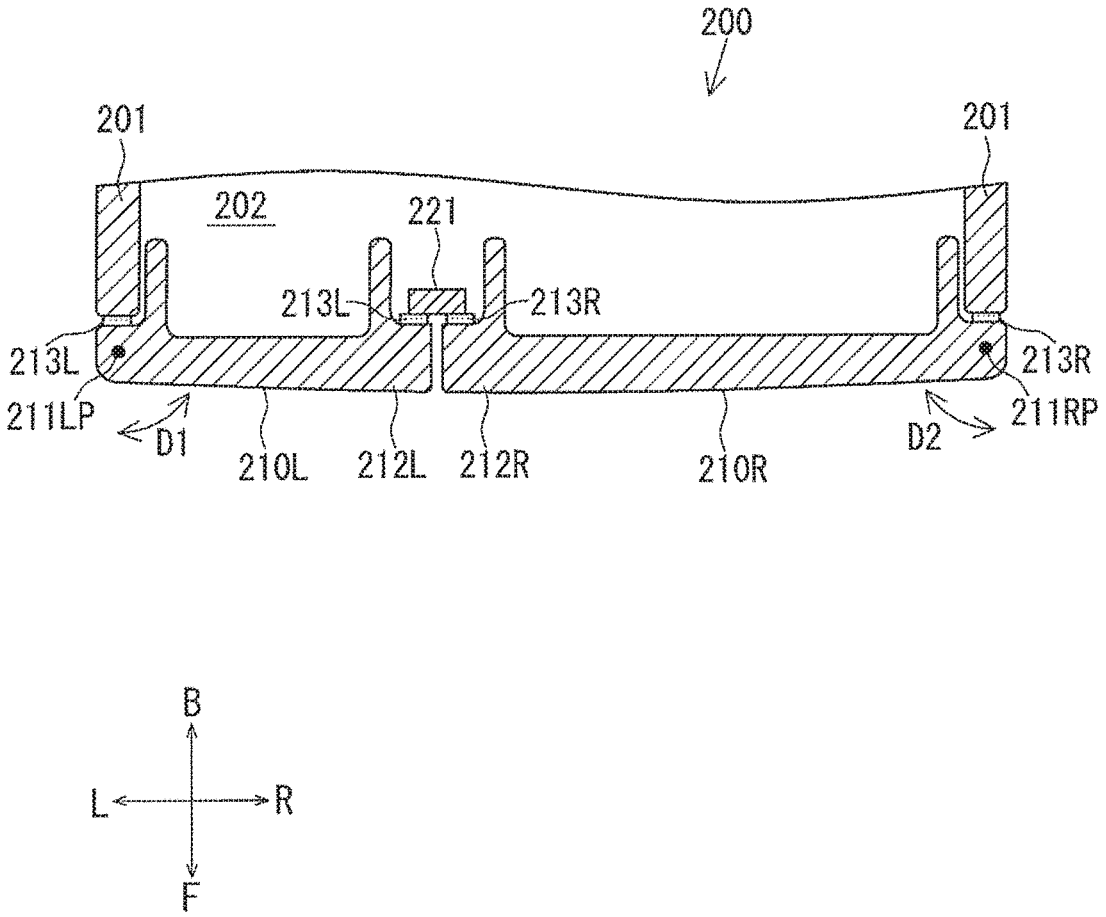
FIG. 2 is a plan sectional view taken along line A-A of FIG. 1.

FIG. 2 is a plan sectional view taken along line A-A of FIG. 1. As illustrated in FIG. 2, left door 210L and right door 210R are rotatably supported with respect to refrigerator main body 201. Left door 210L can be opened and closed in direction of arrow D1 around rotation shaft 211LP of hinge 211L. Right door 210R can be opened and closed in direction of arrow D2 around rotation shaft 211RP of hinge 211R.

Rotary partition body 221 is provided inside free end 212L of left door 210L. In a state where left door 210L and right door 210R are closed, gasket 213L of left door 210L and gasket 213R of right door 210R are brought into close contact with rotary partition body 221 to suppress leakage of cold air from refrigerating storage chamber 202.

Figure 3:
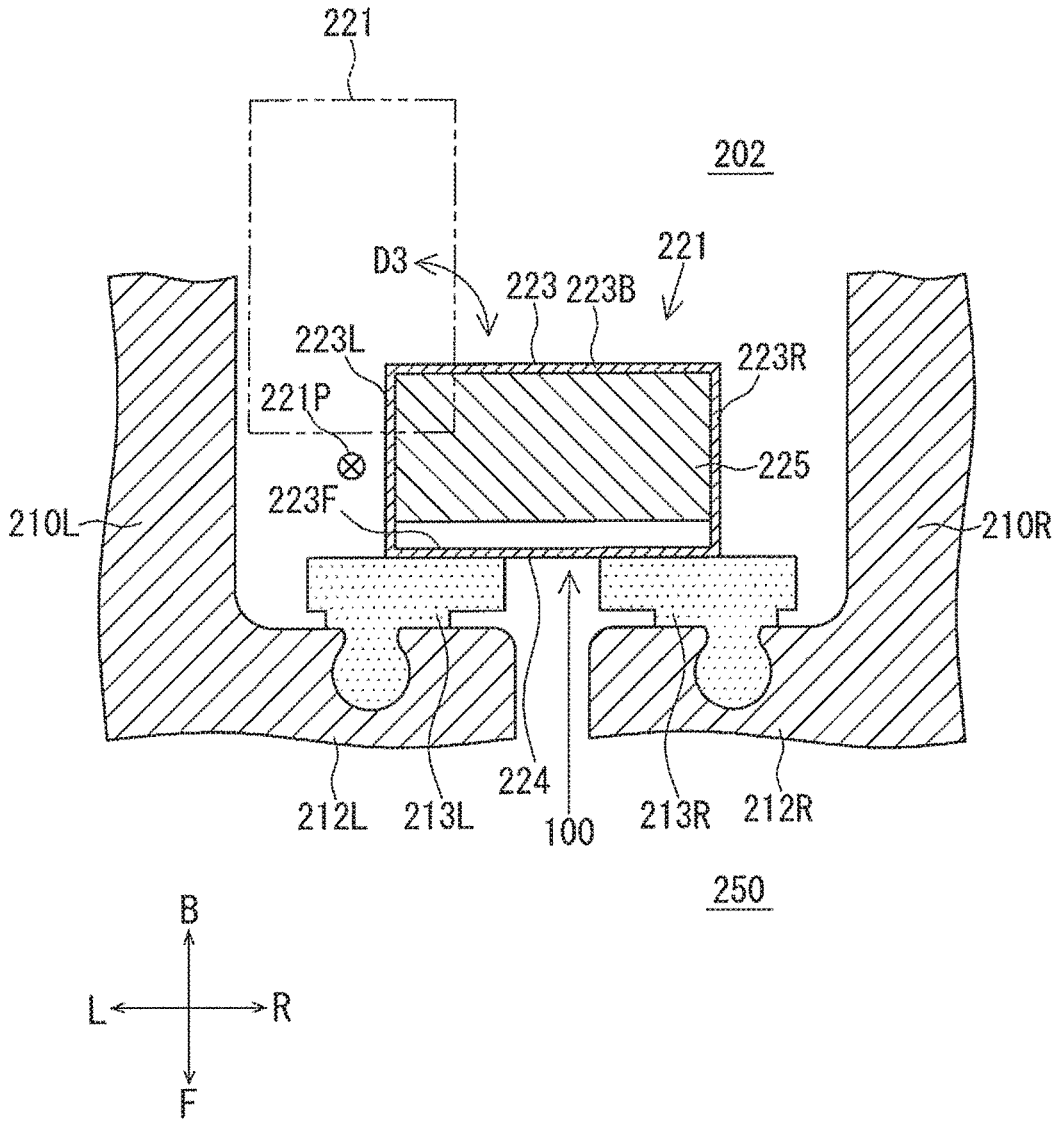
FIG. 3 is an enlarged view of a vicinity of a rotary partition body of FIG. 2.

FIG. 3 is an enlarged view of a vicinity of rotary partition body 221 of FIG. 2. Rotary partition body 221 mainly includes outer shell 223 and heat insulating material 225. Outer shell 223 is a hollow member having a substantially square cross section. Outer shell 223 has a substantially parallelepiped shape extending in a vertical direction (see FIG. 4). Outer shell 223 includes a plurality of members using a metal material or a synthetic resin material. The interior of outer shell 223 is filled with heat insulating material 225.

Rotary partition body 221 is supported by left door 210L by a hinge (not illustrated), and is rotatable in a direction of arrow D3 around virtual rotation shaft 221P. In a state where left door 210L is closed with respect to refrigerator main body 201 (the state of FIG. 2), rotary partition body 221 is rotated to the right with respect to left door 210L as indicated by a solid line in FIG. 3. In a state where left door 210L is opened with respect to refrigerator main body 201, rotary partition body 221 is rotated to the left with respect to left door 210L as indicated by a virtual line (two-dot chain line) in FIG. 3.

Here, rotary partition body 221 has a portion in contact with cold air in refrigerating storage chamber 202 and a portion facing outside air 250. There is a temperature difference between the cold air in refrigerating storage chamber 202 and outside air 250, and the temperature of the portion facing outside air 250 is lowered by transfer of cold from inside refrigerating storage chamber 202.

Specifically, outer shell members 223L, 223R and 223B constituting outer shell 223 of rotary partition body 221 face the inside of refrigerating storage chamber 202 and are in contact with the cold air in refrigerating storage chamber 202. In contrast, outer shell member 223F is provided on a side of outside air 250, and a portion of outer shell member 223F where gasket 213L and gasket 213R of left door 210L and right door 210R are not in close contact faces outside air 250.

The cold in refrigerating storage chamber 202 is transferred to outer shell member 223F via outer shell members 223L, 223R and 223B facing refrigerating storage chamber 202. Therefore, the temperature of surface 224 of outer shell member 223F on the side of outside air 250 is lower than the temperature of the outside air.

Moreover, gaskets 213L and 213R which are in close contact with outer shell member 223F are in contact with not only outside air 250 but also the cold air inside refrigerating storage chamber 202. Accordingly, gaskets 213L and 213R themselves are also cooled by the cold air in refrigerating storage chamber 202. Therefore, the cold in refrigerating storage chamber 202 is transferred to outer shell member 223F also via gaskets 213L and 213R, and the temperature of surface 224 of outer shell member 223F is lower than the temperature of the outside air.

As described above, since the cold in refrigerating storage chamber 202 is transferred to the side of outside air 250 of rotary partition body 221, the temperature of surface 224 of outer shell member 223F may be lower than dew point temperature of outside air 250. As a result, water vapor in outside air 250 condenses and dew condensation may be generated on surface 224 of outer shell member 223F. In order to prevent dew condensation, a conventional refrigerator has been provided with a heating apparatus that heats an entire surface on the side of the outside air of the rotary partition body. In contrast, refrigerator 200 of the present embodiment is provided with dew condensation removal structure 100 that removes dew condensation on rotary partition body 221. Hereinafter, dew condensation removal structure 100 will be described.

[Dew Condensation Removal Structure]

Figure 4:
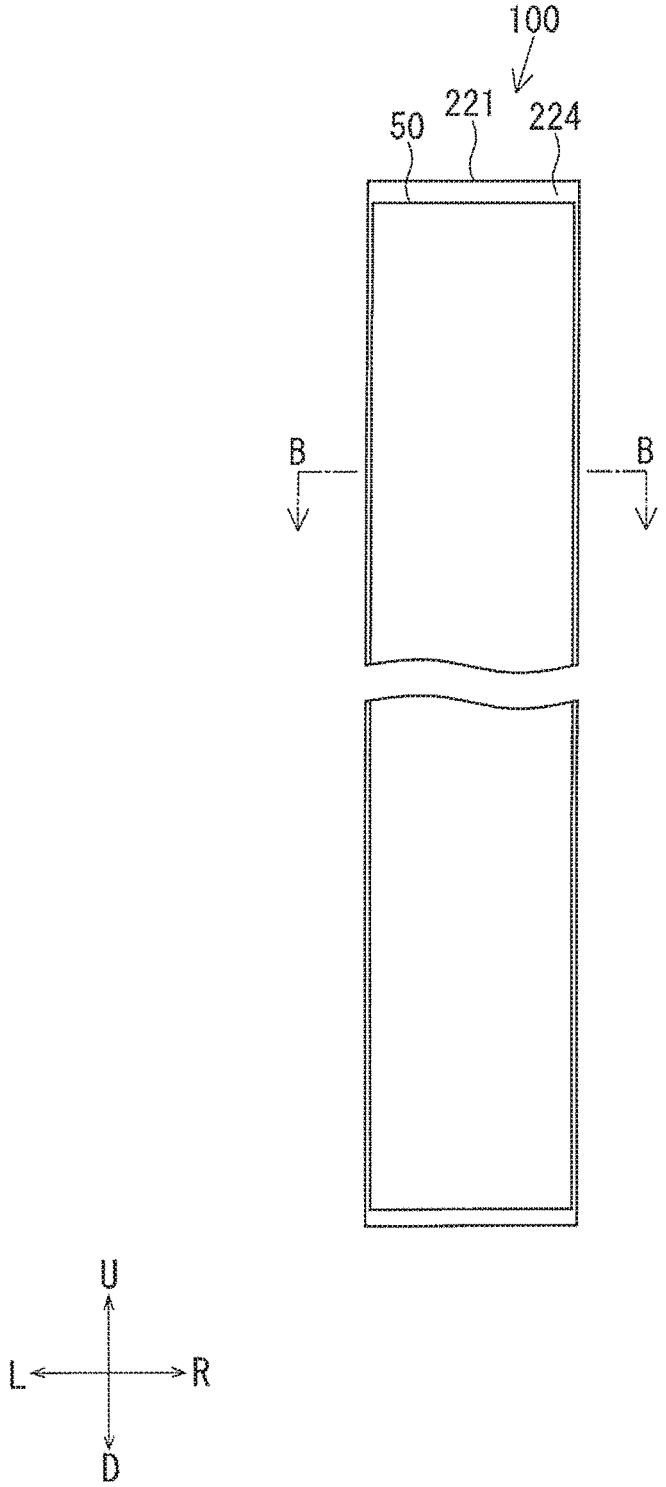
FIG. 4 is a front view illustrating a schematic configuration of the rotary partition body.

FIG. 4 is a front view illustrating a schematic configuration of rotary partition body 221. Dew condensation removal structure 100 of the present embodiment includes rotary partition body 221 and dew condensation conveyance section 50.

Rotary partition body 221 has surface 224 on the side of outside air 250, surface 224 being indirectly cooled by the cold in refrigerating storage chamber 202. Surface 224 has a portion in contact with outside air 250. Rotary partition body 221 corresponds to the cooling structure of the embodiments, and surface 224 corresponds to the cooling surface of the embodiments.

Dew condensation conveyance section 50 is formed directly on surface 224. Dew condensation conveyance section 50 of the present embodiment is provided on substantially entire surface of surface 224. Dew condensation conveyance section 50 includes conveyance path 54 (see FIG. 5). As will be described in detail later, conveyance path 54 is configured to convey dew condensation generated on the surface of dew condensation conveyance section 50 by capillary phenomenon.

Therefore, the dew condensation generated on surface 224 is conveyed so as to spread on conveyance path 54. Since the dew condensation is conveyed so as to spread to surrounding by conveyance path 54, surface area of the dew condensation in contact with the outside air is enlarged, vaporization is promoted and the dew condensation is removed.

Figure 5:
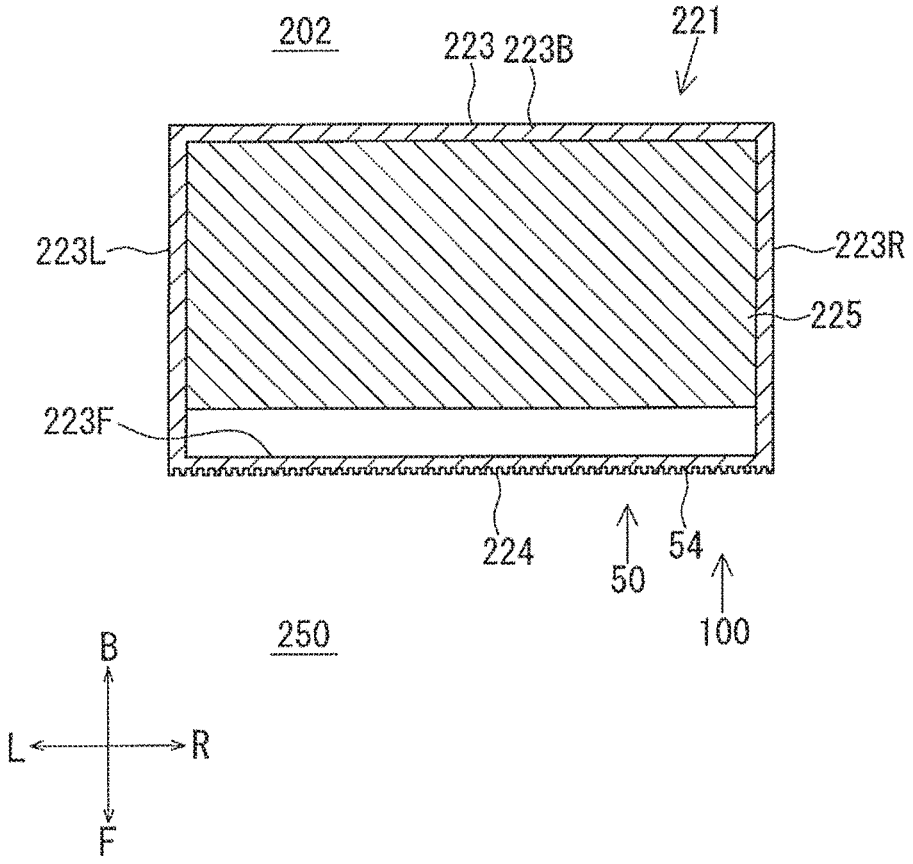
FIG. 5 is a cross-sectional view taken along line B-B of FIG. 4.

FIG. 5 is a cross-sectional view taken along line B-B of FIG. 4. In dew condensation conveyance section 50 of the present embodiment, conveyance path 54 is formed directly on surface 224 of outer shell member 223F.

Figure 6A:
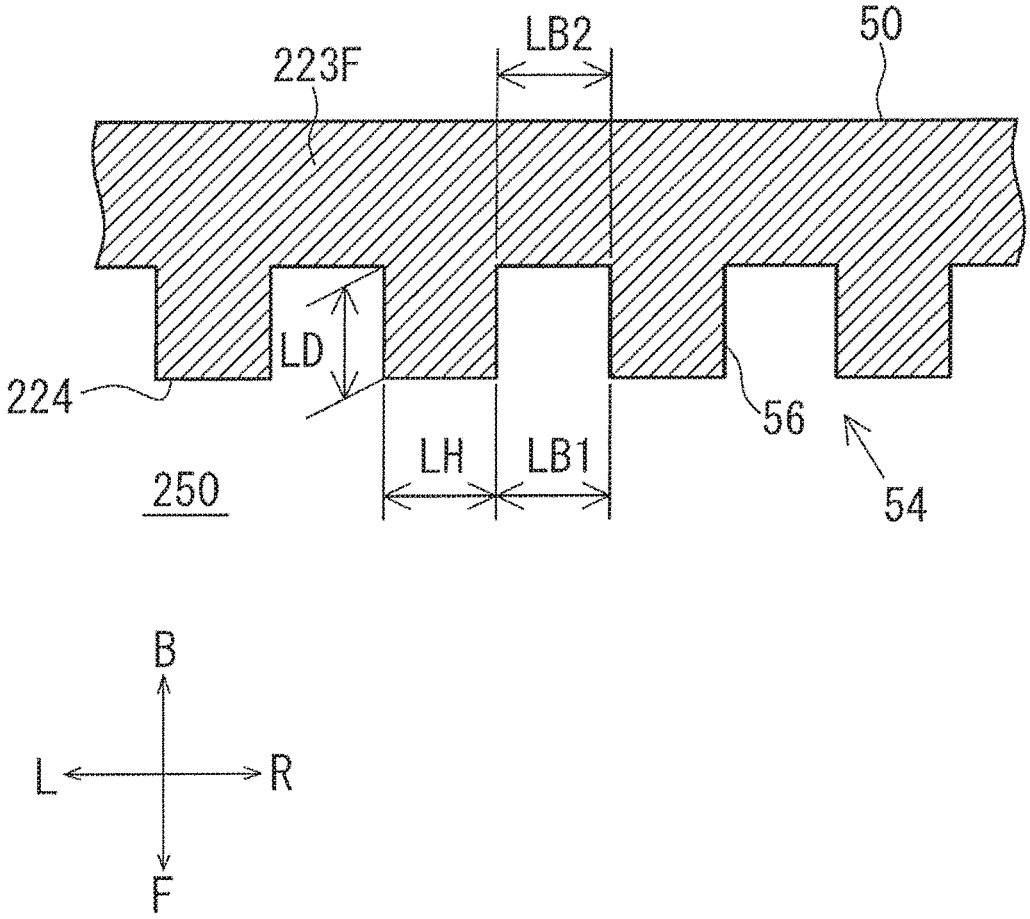
FIG. 6A is a plan sectional view enlarging a dew condensation conveyance section of FIG. 5.

FIG. 6A is a plan sectional view enlarging dew condensation conveyance section 50 of FIG. 5. Conveyance path 54 includes a plurality of fine grooves 56.

Each of grooves 56 is formed in a shape and size that easily generate capillary phenomenon such that dew condensation (water generated by condensation of water vapor in the air) can be transported by the capillary phenomenon. In groove 56 in FIG. 6A, width LB1 of an opening portion and width LB2 of a bottom portion are equal. Width LB1 of the opening portion and width LB2 of the bottom portion are preferably about 10 μm to 500 μm. Moreover, depth LD of groove 56 is preferably about 10 μm to 500 μm, and interval LH between adjacent grooves 56 is preferably about 10 μm to 500 μm. Various methods such as injection molding and cutting can be used to form grooves 56. For example, in a case where outer shell member 223F of rotary partition body 221 includes a synthetic resin material, grooves 56 can be formed by injection molding. Moreover, in a case where outer shell member 223F of rotary partition body 221 includes a metal material, grooves 56 can be formed by cutting.

Figure 6B:
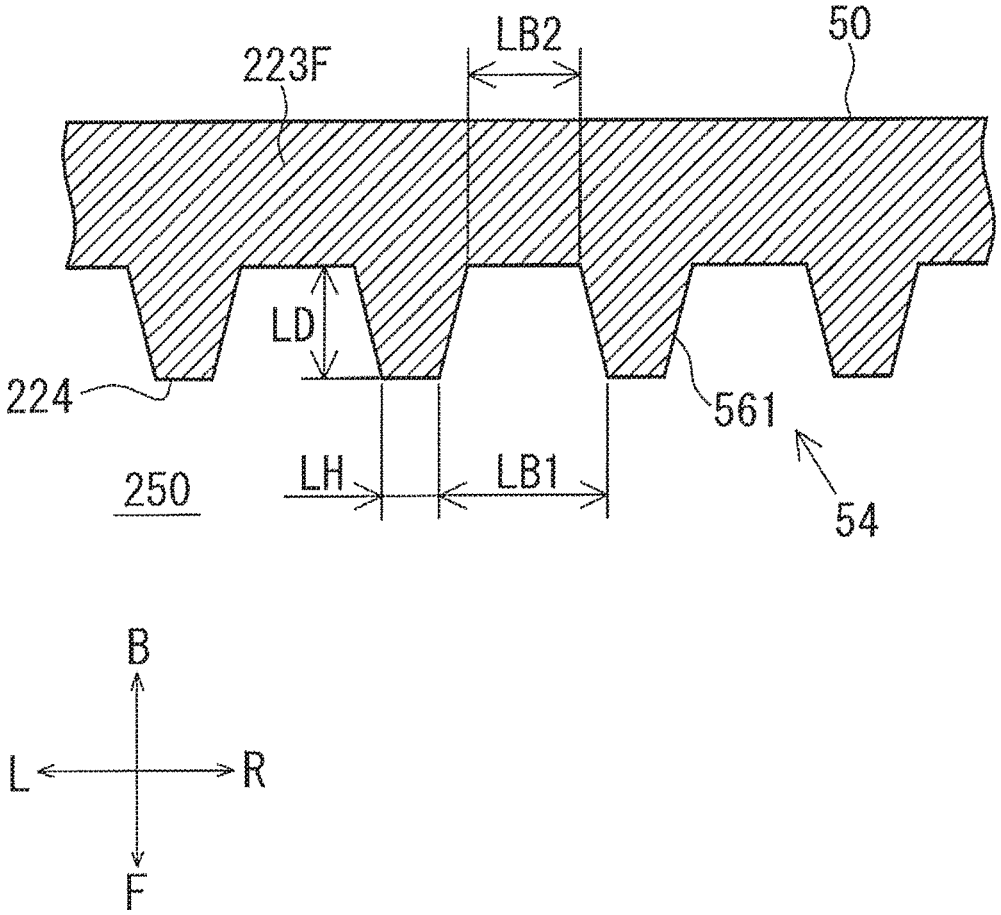
FIG. 6B is a view illustrating a modification of the dew condensation conveyance section.

Note that the shape of groove 56 in FIG. 6A is an example, and groove 56 can be formed into various shapes that easily generate capillary phenomenon. For example, groove 561 may have a substantially trapezoidal shape by setting width LB2 of the bottom portion smaller than width LB1 of the opening portion as groove 561 illustrated in FIG. 6B. Moreover, groove 561 may have a substantially V shape by setting width LB2 of the bottom portion to 0 μm.

Figure 6C:
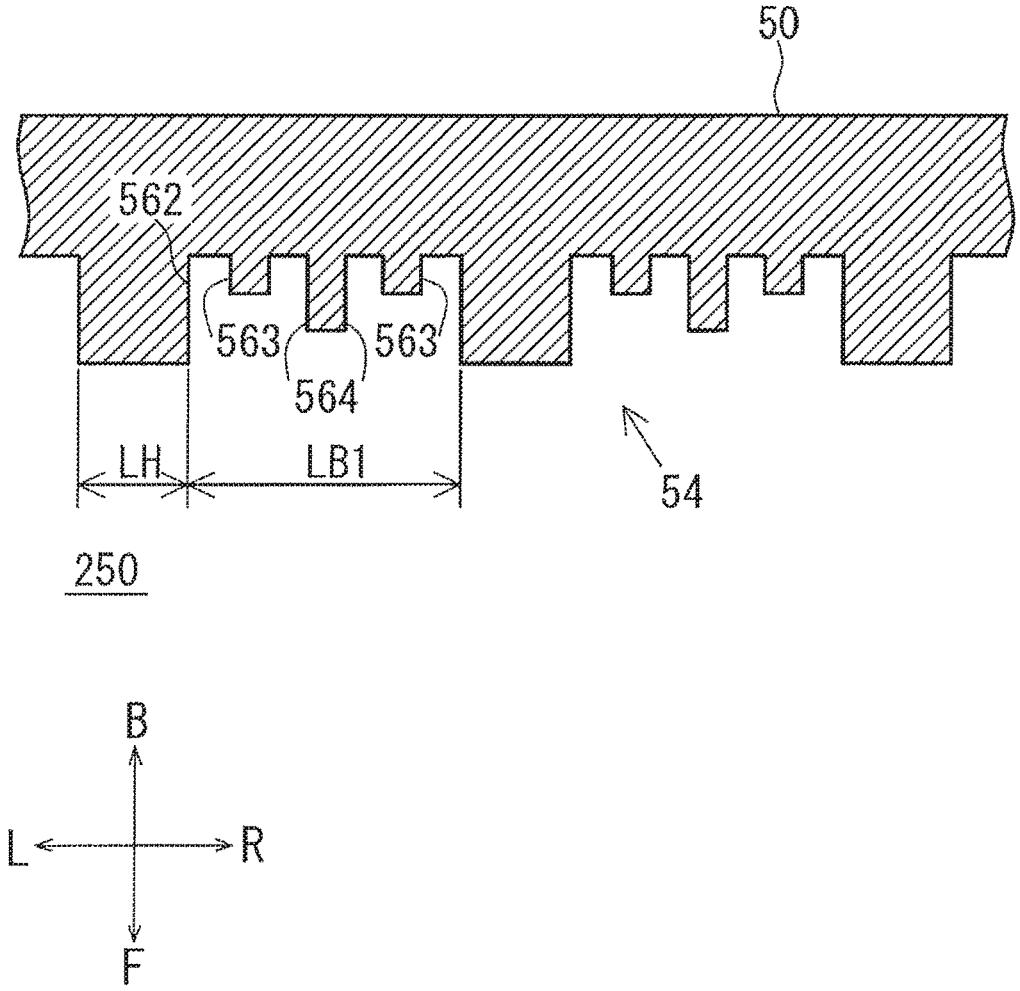
FIG. 6C is a view illustrating another modification of the dew condensation conveyance section.

Moreover, the shapes of grooves 56 may not be uniform, and grooves 56 having different sizes and shapes may be combined. For example, as illustrated in FIG. 6C, other grooves 563 and 564 having different sizes may be formed inside groove 562.

Moreover, although in the present embodiment, the plurality of grooves 56, 561 or 562 is formed linearly and in parallel with one another, the plurality of grooves may not be formed linearly or in parallel as long as dew condensation can be transferred over a wide range. For example, a groove having a bent or curved shape may be formed. Moreover, the plurality of grooves may be formed in various directions or irregular directions.

[Temperature and Humidity Change Test]

Figure 7:
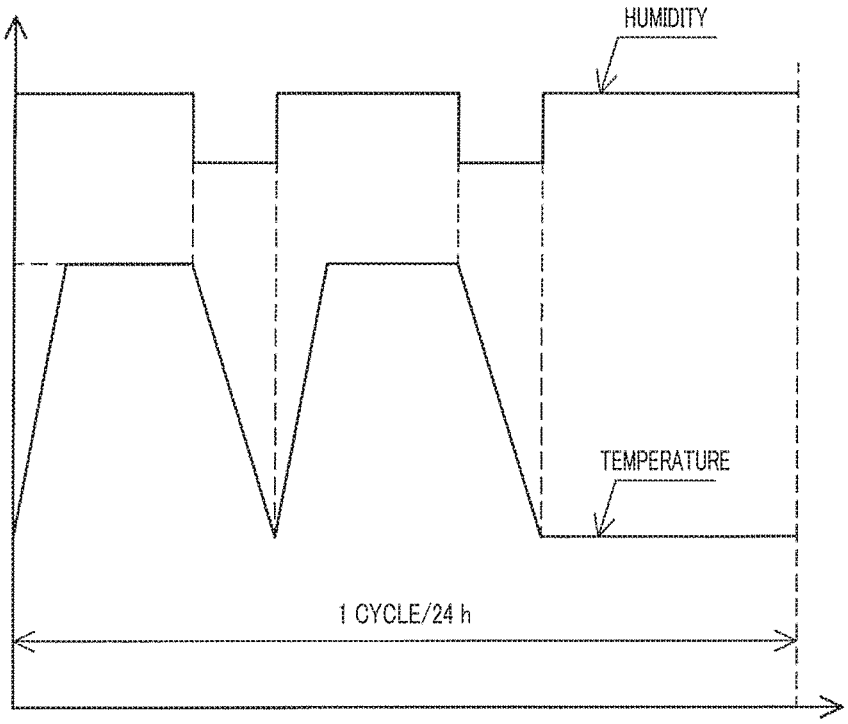
FIG. 7 is a diagram illustrating a temperature and humidity change cycle used for a temperature and humidity change test.

FIG. 7 is a diagram illustrating a temperature and humidity change cycle used for a temperature and humidity change test. In order to verify a dew condensation removal function by dew condensation removal structure 100 of the present embodiment, the temperature and humidity change test was conducted to measure whether dew condensation is generated.

As illustrated in FIG. 7, the temperature and humidity change cycle used for the temperature and humidity change test is based on "Method for evaluating resistance of equipment by respiration (JIS C60068-2-38)". In the temperature and humidity change cycle, one cycle is set to 24 hours, and temperature and humidity are slowly raised or lowered over time. The temperature and humidity change test was performed using refrigerator 200 according to the present embodiment and a conventional refrigerator as a comparison target.

As a result of the temperature and humidity change test, in the conventional refrigerator, a phenomenon was repeated in which dew condensation was generated on the surface of the rotary partition body after a while since the humidity has been raised, and the dew condensation disappeared after a while since the humidity has been lowered. In contrast, in refrigerator 200 according to the present embodiment, no visible dew condensation appeared on surface 224 of rotary partition body 221 regardless of high or low humidity. It is considered that this is due to the fact that even when fine dew condensation is generated on surface 224, the dew condensation is conveyed so as to spread to the surroundings by dew condensation conveyance section 50, such that vaporization of the dew condensation which is spread to the surroundings and surface area of which is enlarged is promoted and the dew condensation is removed.

Effect of Embodiment 1

According to Embodiment 1, since the dew condensation generated on the surface of dew condensation conveyance section 50 is conveyed through conveyance path 54, the surface area of the dew condensation is enlarged and vaporization is promoted. As a result, the dew condensation generated on surface 224 of rotary partition body 221 can be removed, and power consumption necessary to remove the dew condensation can be suppressed.

The dew condensation can be rapidly conveyed through conveyance path 54 having the plurality of grooves 56.

By setting the sizes of the plurality of grooves 56 formed on conveyance path 54 to the above sizes, the dew condensation can be rapidly conveyed by capillary phenomenon and grooves 56 on surface 224 of rotary partition body 221 can be made inconspicuous. Therefore, dew condensation removal structure 100 can be applied to a portion visible from a user and the like.

Moreover, since conveyance path 54 is directly formed on surface 224 of rotary partition body 221, dew condensation removal structure 100 can be easily applied even in a case where surface 224 is large.

Embodiment 2

Dew condensation removal structure 1100 of Embodiment 2 is different from dew condensation removal structure 100 of Embodiment 1 in that dew condensation removal structure 1100 includes diffusion section 170 and heating section 180. In the following description, the same reference signs are given to configurations similar to those in Embodiment 1, description thereof will be omitted, and configurations that are different from those in Embodiment 1 will be mainly described.

Figure 8:
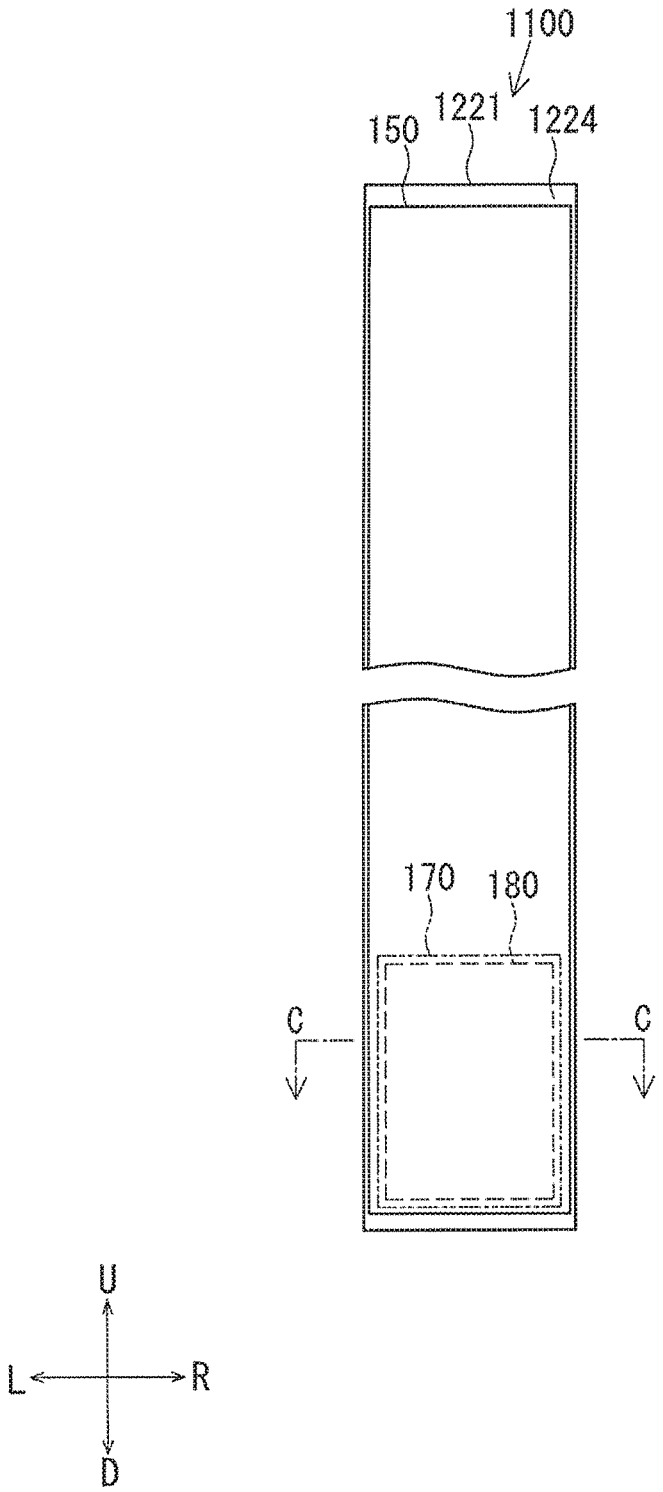
FIG. 8 is a front view illustrating a schematic configuration of a rotary partition body according to Embodiment 2 of the present invention.

FIG. 8 is a front view illustrating a schematic configuration of rotary partition body 1221. Dew condensation removal structure 1100 of the present embodiment includes rotary partition body 1221, dew condensation conveyance section 150, diffusion section 170 and heating section 180.

Figure 9:
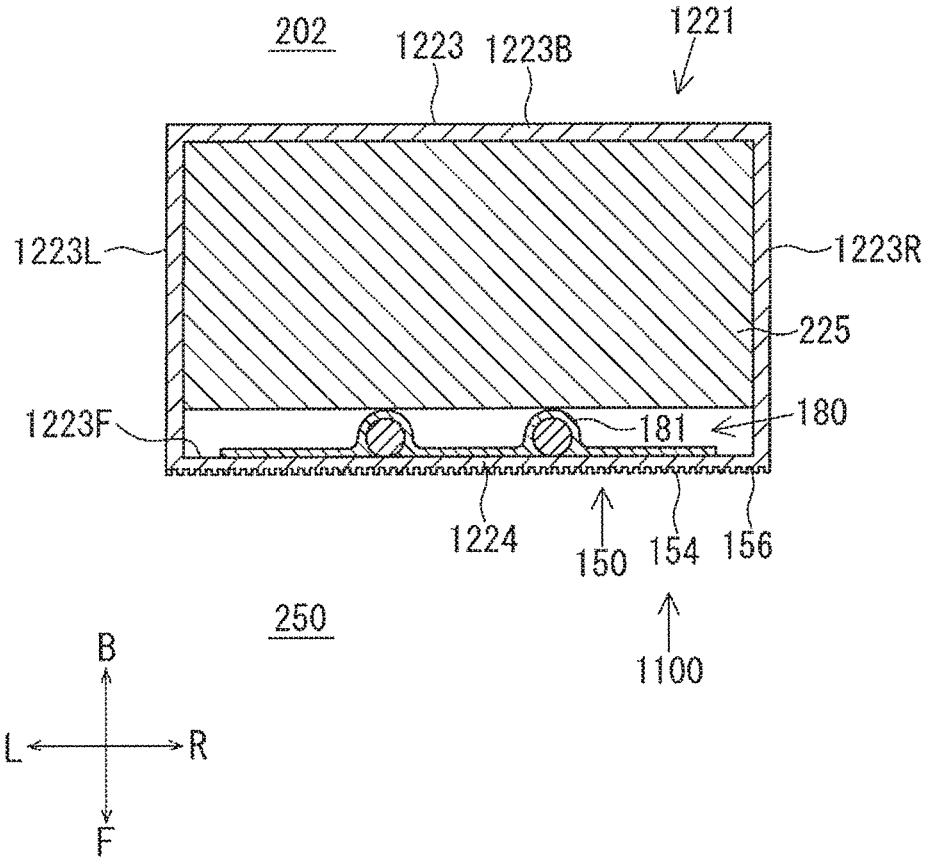
FIG. 9 is a cross-sectional view taken along line C-C of FIG. 8.

Outer shell 1223 of rotary partition body 1221 has substantially the same configuration as outer shell 223 of rotary partition body 221 of Embodiment 1 (see FIG. 9). As illustrated in FIG. 8, rotary partition body 1221 has surface 1224 on the side of outside air 250, surface 1224 being indirectly cooled by the cold in refrigerating storage chamber 202. Surface 1224 has a portion in contact with outside air 250. Rotary partition body 1221 corresponds to the cooling structure of the embodiments, and surface 1224 corresponds to the cooling surface of the embodiments.

Dew condensation conveyance section 150 is formed directly on surface 1224 of rotary partition body 1221. Dew condensation conveyance section 150 of the present embodiment is provided on substantially entire surface of surface 1224. Dew condensation conveyance section 150 includes conveyance path 154. Conveyance path 154 includes a plurality of fine grooves 156. The plurality of grooves 156 is formed in parallel to one another. Moreover, grooves 156 are formed in the vertical direction so as to extend from each portion of dew condensation conveyance section 150 toward diffusion section 170. As a result, dew condensation generated on surface 1224 is rapidly conveyed through conveyance path 154 to diffusion section 170.

Diffusion section 170 is provided in the lower part of surface 1224. Diffusion section 170 is heated by heating section 180. Heating section 180 is provided inside rotary partition body 1221. Temperature of a part of surface 1224 on diffusion section 170 is set to be higher than temperature of a part of surface 1224 other than the part on diffusion section 170, and for example, the temperature is set to approximately equal to room temperature or temperature higher than dew point temperature. Accordingly, vaporization of the dew condensation conveyed to diffusion section 170 is promoted in diffusion section 170. As a result, the dew condensation is removed.

FIG. 9 is a cross-sectional view taken along line C-C of FIG. 8. Conveyance path 154 includes the plurality of fine grooves 156. Grooves 156 are formed to be in parallel with one another in the vertical direction so as to extend from each portion of dew condensation conveyance section 150 toward diffusion section 170.

Heating section 180 includes heating apparatus 181 such as an aluminum foil heater. Heating apparatus 181 is connected to a power supply apparatus (not illustrated). An amount of electric power supplied to heating apparatus 181 is preferably controlled on the basis of temperature information and humidity information of outside air, but constant electric power may be constantly supplied. In order to prevent dew condensation, a conventional refrigerator has been provided with a heating apparatus that heats an entire surface of the rotary partition body on a side of the outside air. In dew condensation removal structure 1100 of the present embodiment, heating apparatus 181 is provided only in heating section 180. Therefore, it is possible to suppress the amount of electric power necessary to remove the dew condensation as compared with the conventional refrigerator.

Effect of Embodiment 2

According to Embodiment 2, the dew condensation generated on the surface of dew condensation conveyance section 150 is conveyed to diffusion section 170, and vaporization is promoted in diffusion section 170. Therefore, the dew condensation on surface 1224 can be removed.

Moreover, since heating section 180 is provided only in a part of rotary partition body 1221, heating section 180 can be downsized, and the power consumption necessary to remove the dew condensation can be suppressed.

[Modification]

Dew condensation removal structure 100 and the cooling/heating equipment according to the embodiments of the present invention are not limited to those in the embodiments described above. For example, the cooling/heating equipment may be refrigerating/freezing equipment other than a household refrigerator, air conditioning equipment, or the like. Moreover, dew condensation removal structure 100 may be provided at a part other than the rotary partition body of the household refrigerator. For example, dew condensation removal structure 100 may be applied to an indoor machine of the air conditioning equipment.

In the embodiments, in dew condensation conveyance section 50 of dew condensation removal structure 100, conveyance path 54 is formed directly on surface 224 (the portion corresponding to the cooling surface in the embodiments) of rotary partition body 221, but the present invention is not limited to this configuration. For example, conveyance path 54 may be formed on a sheet-like member, and the sheet-like member may be stuck to surface 224 (the portion corresponding to the cooling surface in the embodiments) of rotary partition body 221 such that conveyance path 54 faces outside air 250. In this case, the dew condensation removal structure can be easily formed by sticking the sheet-like member on which conveyance path 54 is formed to the cooling surface.

Moreover, although heating section 180 is provided in diffusion section 170 in Embodiment 2, heating section 180 may not be provided. For example, diffusion section 170 may be provided at a portion having higher temperature than the portion corresponding to the cooling surface of the embodiments (in Embodiment 1, surface 224 of rotary partition body 221), and heating section 180 may not be provided. The portion having the temperature higher than that of the cooling surface is, for example, a portion where cold of refrigerator 200 is not transferred. In this case, since heating section 180 is not provided, the dew condensation can be removed without consuming electric power.

In Embodiment 2, one diffusing portion 170 is provided, but a plurality of diffusion sections 170 may be provided so as to further promote vaporization of the dew condensation.

Although the embodiments of the present invention have been described above, the above embodiments are merely examples for implementing the present invention. Therefore, the present invention is not limited to the above embodiments, and the above embodiments can be appropriately modified and implemented without departing from the spirit of the present invention.

INDUSTRIAL APPLICABILITY

Since a dew condensation removal structure and cooling/heating equipment including the dew condensation removal structure of the present invention can remove dew condensation while suppressing power consumption, the dew condensation removal structure and the cooling/heating equipment can be applied to equipment using cold such as refrigerating/freezing equipment and air conditioning equipment.

REVERENCE SIGNS LIST

50 dew condensation conveyance section
54 conveyance path
56 groove
LH interval
100 dew condensation removal structure
150 dew condensation conveyance section
154 conveyance path
156 groove
170 diffusion section
180 heating section
181 heating apparatus
200 refrigerator
201 refrigerator main body
202 refrigerating storage chamber
203 ice making chamber
204 switchable storage chamber
205 freezing storage chamber
206 vegetable storage chamber
210L left door
210R right door
211L hinge
211LP rotation shaft
211R hinge
211RP rotation shaft
212L free end
212R free end
213 door
213L gasket
213R gasket
214 door
215 door
216 door
221 rotary partition body
221P rotation shaft
223 outer shell
223F outer shell member
223L outer shell member
224 surface
225 heat insulating material
250 outside air
561 groove
562 groove
563 groove
564 groove
LB1 width
LB2 width
1100 dew condensation removal structure
1221 rotary partition body
1223 outer shell
1224 surface

The invention claimed is:

1. A dew condensation removal structure, comprising:

a cooling structure having a cooling surface that is directly or indirectly cooled by cold, the cooling surface facing outside air; and a dew condensation conveyance section provided on the cooling surface, the dew condensation conveyance section having a conveyance path that conveys dew condensation generated on a surface of the dew condensation conveyance section, a diffusion section having a surface temperature higher than a surface temperature of the cooling surface, a heating section that raises a temperature of the diffusion section, the heating section and the diffusion section are provided in only a part of the cooling surface, the dew condensation conveyance section having a plurality of protrusions which form a plurality of grooves, the conveyance path being formed by the plurality of grooves, the plurality of grooves are formed over an upper portion and a lower portion of the cooling surface, and the diffusion section is located only in the lower portion of the cooling surface, wherein the plurality of grooves located in the upper portion convey the dew condensation generated on the cooling surface to the plurality of grooves located in the lower portion, and the dew condensation is vaporized in the lower portion by the diffusion section, and at least a portion of the plurality of grooves are exposed to the outside air.

2. The dew condensation removal structure according to claim 1, wherein each of the plurality of grooves has a width of an opening portion of 10 μm to 500 μm, a depth of 10 μm to 500 μm, and an interval to an adjacent groove of 10 μm to 500 μm.

3. The dew condensation removal structure according to claim 1, wherein the dew condensation conveyance section includes the conveyance path formed on the cooling surface.

4. The dew condensation removal structure according to claim 1, wherein the dew condensation conveyance section includes a sheet-like member and the conveyance path formed on a surface of the sheet-like member, and the sheet-like member is stuck to the cooling surface.

5. The dew condensation removal structure according to claim 1, wherein the cooling structure is a rotary partition body.

6. Cooling equipment comprising the dew condensation removal structure according to claim 1.

7. The dew condensation removal structure according to claim 1, wherein the cross sectional shapes of the plurality of grooves are not uniform but are combinations of different shapes.

8. The dew condensation removal structure according to claim 1, wherein the plurality of grooves are formed in the vertical direction so as to extend toward the diffusion section.

9. The dew condensation removal structure according to claim 1, wherein the plurality of grooves are directly exposed to the outside air.

10. The dew condensation removal structure according to claim 1, wherein the plurality of grooves form an outermost surface of the dew condensation section.

11. The dew condensation removal structure according to claim 1, wherein the heating section and the diffusion section are located only in the lower part of the cooling surface.

12. The dew condensation removal structure according to claim 1, wherein the bases of the plurality of grooves are void of openings.

13. Cooling equipment comprising:

a storage chamber;

a first door and a second door located at an opening portion of the storage chamber; and the dew condensation removal structure according to claim 5 arranged at a position surrounded by the storage chamber, the first door, and the second door.

14. The cooling equipment according to claim 13, wherein the cooling surface is a surface of the dew condensation removal structure between the first door and the second door.

* * * * *